United States Patent [19]

Anderson

[11] 4,406,435

[45] Sep. 27, 1983

[54] WALL MOUNT BRACKET FOR A VENETIAN BLIND HEADRAIL

[75] Inventor: Richard N. Anderson, Owensboro, Ky.

[73] Assignee: Hunter Douglas, Inc., Totowa, N.J.

[21] Appl. No.: 268,646

[22] Filed: May 29, 1981

[51] Int. Cl.[3] ..... A47M 1/10

[52] U.S. Cl. ..... 248/261

[58] Field of Search ..... 248/261, 264, 262, 263, 248/265, 254, 312, 312.1, 311.2; 16/94 R, 95 R

[56] References Cited

U.S. PATENT DOCUMENTS

| | | | |
|---|---|---|---|
| 1,227,165 | 5/1917 | Marin | 248/312.1 |
| 2,508,737 | 5/1950 | Zeto | 248/264 |
| 2,674,432 | 4/1954 | Lorentzen | 248/264 |
| 3,168,275 | 2/1965 | Grondin | 248/311.2 |
| 3,938,769 | 2/1976 | Wetherbee | 248/312 |
| 4,071,976 | 2/1978 | Chernewski | 248/312.1 |
| 4,283,034 | 8/1981 | Sheehan | 248/263 |

*Primary Examiner*—William H. Schultz
*Assistant Examiner*—Ramon O. Ramirez
*Attorney, Agent, or Firm*—Pennie & Edmonds

[57] ABSTRACT

A wall mount bracket for mounting a headrail having at least one flange with an inturned rim on the free end of the flange to a wall. The bracket has a vertically extending wall engaging member and a downwardly opening retaining groove on the upper part of the member. An inwardly extending lip is spaced from the wall engaging member and supports the inturned rim of the flange.

10 Claims, 7 Drawing Figures

FIG. 2
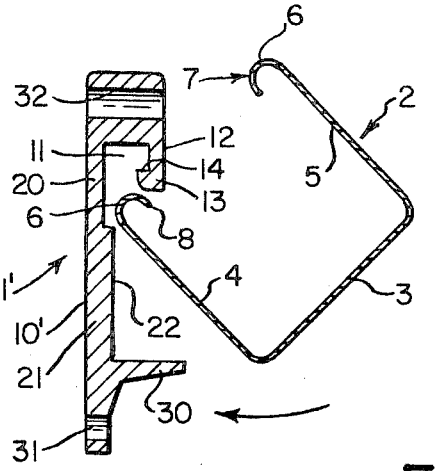
FIG. 1
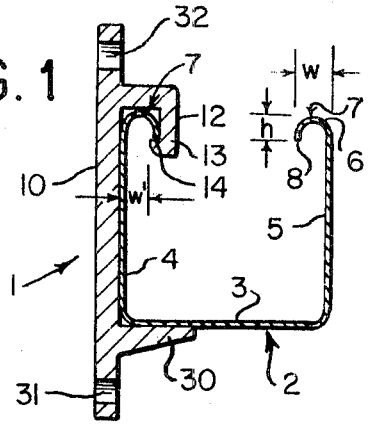
FIG. 3
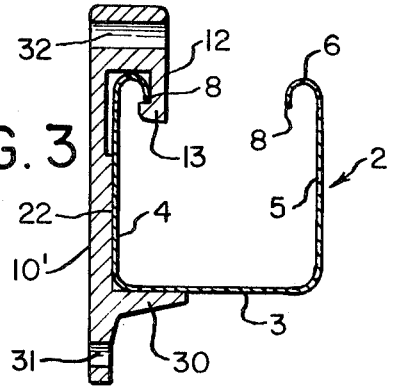
FIG. 4
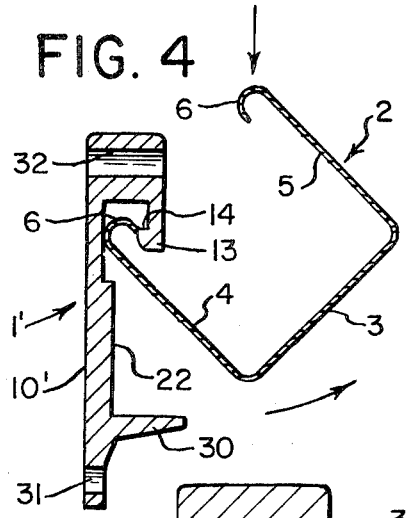
FIG. 6
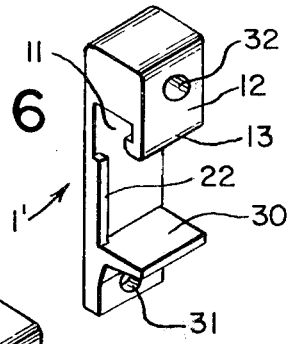
FIG. 5
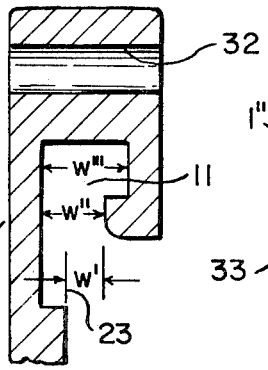
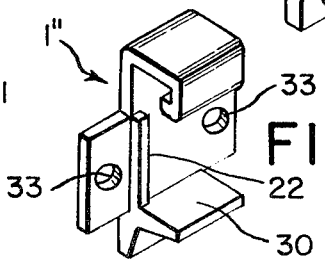
FIG. 7

WALL MOUNT BRACKET FOR A VENETIAN BLIND HEADRAIL

TECHNICAL FIELD

This invention relates to headrail brackets utilized to mount venetian blind headrails to walls and the like.

BACKGROUND ART

Brackets for mounting venetian blind headrails often have to be made to close tolerances to assure accurate and tight fit of the brackets with headrails which necessarily increases the cost of manufacture of both the bracket and the headrail. Further the mounting of the headrail often is complicated, requires special tools and the manner of mounting is not readily apparent.

It is therefore an object of my invention to provide for a wall mount bracket for a venetian blind headrail which will be low in cost, involve a minimum of complicated tooling to manufacture and which will be less tolerance sensitive with respect to a headrail which is to be mounted thereon. It is a further object to provide a bracket which will provide easy mounting of a headrail thereon and where the method of mounting will be apparent to a non-professional installer.

DISCLOSURE OF INVENTION

Broadly, a wall mount bracket according to the invention is for use with a venetian blind headrail adapted to support a venetian blind assembly where the headrail has an upstanding flange including an inturned rim at its upper free end. The bracket comprises a vertical extending walll engaging member adapted to be affixed to a wall. The wall engaging member has a groove in an upper portion thereof forming a downwardly facing opening including a depending side wall which is spaced from the vertical extending wall engaging member.

In a preferred form of the invention, the groove forms a retaining groove having an inwardly extending lip which supports an inturned rim of a flange of the headrail. The end of the lip is horizontally spaced from the wall engaging member to form an opening therebetween where the width of the opening is greater than the height of the inturned rim of the flange taken between the end of the rim and the upper free end of the flange. The wall engaging member has a line projected vertically from a lower portion thereof such that the horizontal distance between the end of the lip and the line is less than the width of the rim taken at its widest point between its outer surfaces. The weight of the headrail and any venetian blind assembly is supported by the lip with the result that the center of gravity of the headrail and venetian blind assembly will tend to rotate the headrail to press the flange against the lower portion of the wall engaging member to maintain the rim on the lip. The headrail is attached to the bracket by rotating the headrail so that the inturned rim of the flange may be lifted and inserted into the opening after which the headrail is rotated to a vertical position whereby the lip may support the headrail.

In the preferred form of the invention, a portion of the vertically extending wall engaging member oppostie the lip and the depending wall forms an offset with the opening between the side wall and the offset being greater than the width of the inturned rim taken at its widest point between its outside surfaces. By this construction variances in tolerances of the inturned rim and width of the groove may be accommodated. A shoulder is provided on the vertically extending wall member below the offset portion so as to engage the flange of the headrail to insure that the end of the inturned rim of the headrail will not slide off of the lip because of any horizontal movement of the headrail. The projected line is taken from the top of the shoulder.

A horizontally extending shelf may be connected to a bottom portion of the vertically extending wall member to engage a web of the headrail to provide additional support therefore.

In a further form of the invention, the vertically extending wall engaging member does not include any lip but instead, has only the spaced depending side wall and the horizontally extending shelf. In this form of the invention, the complete weight of the headrail is supported by the shelf with the depending side wall preventing rotation of the headrail away from the wall engaging member by engaging the side of the inturned end of the flange.

BRIEF DESCRIPTION OF DRAWINGS

FIG. 1 is a sectional view of a wall bracket constructed according to the invention illustrating a headrail mounted to the bracket;

FIG. 2 is a sectional view of a further embodiment of the bracket illustrating mounting of a headrail to the bracket;

FIG. 3 is a view similar to FIG. 2 illustrating the headrail in mounted position on the bracket;

FIG. 4 is a view similar to FIG. 1 illustrating the detachment of the headrail from the bracket of FIG. 1;

FIG. 5 is an enlarged sectional view of a portion of the bracket of FIG. 2;

FIG. 6 is an isometric view of the bracket of FIG. 2; and

FIG. 7 is an isometric view of the further embodiment of the bracket of FIG. 2.

DESCRIPTION OF THE PREFERRED EMBODIMENTS

Referring to FIG. 1, there is illustrated a wall mount bracket 1 constructed according to the invention having a headrail 2 mounted thereon adapted to support a venetian blind assembly, not shown. The headrail 2 comprises a web portion 3 having a rear flange 4 and a front flange 5. Both the rear and front flanges have similar inturned rims 6 at their upper free ends 7 with the ends 8 of the rims being turned approximately 180° with respect to the flanges. The width w of each inturned rim 6 as shown in FIG. 1 taken at its widest point between its outside surfaces is greater than the height h taken between the end 8 of the rim and the upper free end 7 of the flange. The headrail 2 may be conveniently formed of a sheet metal material.

The wall mount bracket 1 comprises a vertically extending wall engaging member 10 having a downwardly opening retaining groove 11 formed by a depending side wall 12 which is spaced from the vertically extending wall engaging member. The wall 12 may have an inwardly extending lip 13 including a horizontally extending support surface 14 which, as shown in FIG. 1, is adapted to support the end 8 of the inturned rim 6 of the rear flange when the headrail is installed on the bracket. The end of the lip 13 is spaced from the wall engaging member to form an opening for the groove 11 having a width w' which is less than that of the width w of the inturned rim 6. The width of the groove 11 is substantially the same as the width w.

The manner in which the headrail 2 is mounted onto and removed from the bracket 1 is described hereinafter with reference to FIGS. 2–4.

Referring to FIG. 2, there is illustrated a further embodiment of a bracket 1' wherein like parts with that of the bracket of FIG. 1 have the same identifying numerals. The bracket 1' differs mainly from the bracket 1 of FIG. 1 in having an offset portion 20 in the vertically engaging wall engaging member 10' located above a lower portion 21 of the member. The offset portion is formed by a shoulder 22 which projects outwardly from the vertically extending wall engaging member 10' a distance which, if the shoulder were projected vertically upwardly would produce a line 23 as shown in FIG. 5 spaced from the lip a distance w'. Distance w' is equal to the opening w' of FIG. 1, and specifically is less than the width w of the inturned rim of flange 4.

For purposes of description, the bottom portion of the wall engaging member 10 of FIG. 1 may be considered as having a line projected upwardly therefrom, but since there is no offset portion and since the inner surface of the wall engaging member contacting the flange 4 of the headrail is flush, then the line would be in the same plane as the inner surface.

The manner of installation of the headrail 2 with the bracket 1 is as follows. The headrail is rotated to the position as shown in FIG. 2 and is raised so that the inturned rim 6 of the rear flange 4 may be inserted into the groove 11. The headrail is then rotated in a clockwise direction to the position shown in FIG. 3 where the center of gravity of the headrail and attached venetian blind assembly will tend to rotate the headrail so that the side of the flange 4 engages the shoulder 22. At this point the complete weight of the headrail and venetian blind assembly is supported by the horizontal supporting surface 14 of the lip 13. In order to remove the headrail from the bracket, the headrail is rotated counter-clockwise as shown in FIG. 4 allowing it to be moved slightly to the left after which it may be dropped down to allow the inturned rim to pass through the opening formed between the lip and the offset portion 20. The headrail 2 is mounted onto and removed from the bracket 1 of FIG. 1 in a similar manner.

The offset portion 20 assures that the width 2''' of the groove 11 will be great enough to accommodate an inturned rim of slightly greater width than standard and so allow for variances in manufacturing tolerances of the rim. Also making the width w''' greater than w reduces the degree of tolerance required in forming the groove and thus reduces tooling and manufacturing costs. At the same time the offset portion allows the opening w'' between the offset portion and the end of the lip 13 to be enlarged thus reducing need for close tolerances of this opening.

As shown in FIG. 3, the shoulder 22 prevents movement of the headrail sideways in the left direction and so assures that the end 8 of the rim will not become disengaged from the lip. For this reason, it is important that the height of the shoulder above the vertically extending wall engaging member 10' be such that if the shoulder were projected upwardly, it would form an opening w' between the projection and the end of the lip which is less than the width w of the inturned rim.

If desired, a horizontally extending shelf 30 may be included to engage the bottom of the web 3 to provide an additional degree of support particularly if an extra heavy venetian blind assembly is to be supported by the headrail.

While the brackets illustrated in FIGS. 1–5 include inwardly extending lips, an inwardly extending lip is not an absolute necessity if a horizontally extending shelf portion is utilized. If the lip 13 is eliminated, the entire weight of the headrail would then be carried by the support shelf 30 with the wall 12 preventing rotation of the headrail in a clockwise direction under the influence of the center of gravity of the headrail and attached blind assembly. The manner of installation of the headrail to such a bracket would be the same as that shown in FIGS. 2–4, namely the headrail would be rotated to the position shown in FIG. 2 and raised until the outer surface of the inturned rim 6 engaged the top of the groove 11 after which the headrail would be rotated to a vertical position shown in FIG. 3 wherein the shelf would engage the web 3 and an edge of the rim 6 engage a side wall 12.

As shown in FIGS. 1 and 4, the brackets include mounting holes 31 and 32 through which screws or other mounting means may be inserted to affix the bracket to a wall after which the headrail may be mounted onto the bracket. In the alternative, the headrail may be mounted to the bracket before the bracket is affixed to the wall. This second method of installation is advantageous when very long headrails are utilized as it eliminates the necessity of lining up brackets horizontally on a wall when more than two brackets are used to support the headrail.

In a further form of the invention as shown in FIG. 7, the bracket 1'' may have mounting holes 33 positioned below and on either side of the lip portion such that they may be completely hidden by the headrail after the headrail is installed on the bracket. In this form of the invention, it is necessary that the bracket be initially affixed to the wall after which the headrail is installed thereon. The result of using this form of the bracket is that only a small portion of the bracket is visible after the headrail is mounted thereon.

While the bracket shown in the drawings comprises a "U"-shaped channel member having two upstanding flanges joined by a web section, the invention contemplates use of other forms of brackets. For example, the headrail could comprise only a rear flange where the complete weight of the headrail is carried by the inturned rim on the free upper end of the flange. Another form of bracket would comprise only a rear flange and a bottom web portion where the complete weight of the headrail is carried by the web alone or jointly with the inturned rim.

The construction of the brackets allows them to be conventionally made from a cast plastic material utilizing a minimum amount of material thus reducing costs of material and tooling. It is further seen that the mounting of the headrail onto the bracket does not require any special tools and would be readily apparent to the nonprofessional installer.

I claim:

1. A wall mount bracket for a venetian blind headrail adapted to support a venetian blind assembly where the headrail has at least one upstanding flange having an inturned rim at its upper free end, said bracket comprising in combination:

(a) a vertical extending wall engaging member adapted to be affixed to a wall, and (b) a downwardly opening retaining groove in an upper portion of the wall engaging member including an inwardly extending lip supporting the inturned rim of the flange, with said lip being horizontally spaced from a line projected vertically upwardly from a lower portion of the wall engaging member to form an opening therebetween, the width of which is greater than the height of the inturned rim of the rear flange taken between the end of the rim and the upper free end of the flange and less than the width of the inturned rim taken at its widest point between its outside surfaces, whereby the weight of the headrail and venetian blind assembly will be supported by said lip and whereby the center of gravity of the headrail and venetian blind assembly will tend to rotate the headrail to press the flange against the lower portion of the wall engaging member whereby said rim is maintained on said lip.

2. A wall mount bracket according to claim 1 wherein the lower portion of the wall engaging member against which the flange is pressed is flush with an upper portion of the wall engaging member opposite said lip and wherein the width of the groove is substantially the same as the width of the inturned rim at said widest point.

3. A wall mount bracket according to claim 1 wherein the inwardly extending lip has a horizontally extending support surface supporting the end of the inturned rim.

4. A wall mount bracket according to claim 1 having in addition a horizontally extending shelf engaging the bottom of the lower web of the channel-shaped cross-section to provide an additional support to carry the weight of the headrail.

5. A wall mount bracket according to claim 1 wherein an upper portion of the vertically extending wall member opposite said lip comprises an offset portion forming a part of said groove with the width of the groove being greater than the width of said inturned rim taken at its widest point between its outside surfaces.

6. A wall mount bracket according to claim 5 having in addition a raised shoulder on the lower portion of said vertically extending wall engaging member below said opening engaging the side of the flange to assure that a side of the inturned rim of the flange engages a side wall of said groove whereby a portion of the vertically extending wall member above said shoulder comprises said offset portion and whereby said line is projected vertically from the top of said shoulder.

7. A wall mount bracket according to claim 1 wherein said wall engaging member has mounting holes therein through which fastening means may extend to fasten the member to a wall.

8. A wall mount bracket according to claim 7 wherein said holes are positioned above and below said headrail.

9. A wall mount bracket according to claim 7 wherein said holes are positioned beyond the sides of the lip.

10. A wall mount bracket for a venetian blind headrail adapted to support a ventian blind assembly where the headrail has at least one upstanding flange having an inturned rim at its upper free end and a horizontally extending web portion at its lower end, said bracket comprising in combination:

(a) a vertical extending wall engaging member having mounting holes by which said bracket may be fixed to a wall, (b) a downwardly opening groove in an upper portion of the wall engaging member including a vertically depending wall horizontally spaced from a line projected vertically upwardly from a lower portion of the wall engaging member a distance equal to substantially the width of said inturned rim taken at its widest point between its outside surfaces, and (c) a horizontally extending shelf joined at one end to said vertical extending wall engaging member to engage the bottom of the web portion to carry the complete weight of the headrail and venetian blind assembly and whereby the center of gravity of the headrail and venetian blind assembly will tend to rotate the headrail against the lower portion of the wall engaging member and the outer surface of the inturned rim of the flange against the vertically depending wall whereby said web is maintained on said shelf.

* * * * *